US006566824B2

(12) United States Patent
Panagotacos et al.

(10) Patent No.: US 6,566,824 B2
(45) Date of Patent: May 20, 2003

(54) FLEXIBLE LIGHTING SEGMENT

(75) Inventors: George W. Panagotacos, Corona, CA (US); David G. Pelka, Los Angeles, CA (US)

(73) Assignee: Teledyne Lighting and Display Products, Inc., Hawthorne, CA (US)

( * ) Notice: Subject to any disclaimer, the term of this patent is extended or adjusted under 35 U.S.C. 154(b) by 0 days.

(21) Appl. No.: 09/982,519

(22) Filed: Oct. 16, 2001

(65) Prior Publication Data

US 2003/0071581 A1 Apr. 17, 2003

(51) Int. Cl.[7] ..... G05F 1/00

(52) U.S. Cl. ..... 315/291; 315/183; 362/555

(58) Field of Search ..... 315/291, 178, 315/183, 210, 250, 324, 185; 362/249, 252, 246, 555, 800, 293, 295

(56) References Cited

U.S. PATENT DOCUMENTS

| | | | | |
|---|---|---|---|---|
| 2,448,244 A | | 8/1948 | Arnold | 362/559 |
| 4,143,411 A | | 3/1979 | Roberts | 362/145 |
| 4,271,458 A | | 6/1981 | George, Jr. | 362/236 |
| 4,298,869 A | * | 11/1981 | Okuno | 340/782 |
| 4,388,562 A | | 6/1983 | Josephson | 315/205 |
| 4,625,266 A | | 11/1986 | Winter | 362/146 |
| 4,665,470 A | | 5/1987 | George, Jr. | 362/236 |
| 4,774,434 A | * | 9/1988 | Bennion | 313/500 |
| 4,855,882 A | | 8/1989 | Boss | 362/238 |
| 4,907,361 A | | 3/1990 | Villard | 40/565 |
| 4,908,743 A | | 3/1990 | Miller | 362/238 |
| 4,943,900 A | | 7/1990 | Gartner | 362/227 |
| 4,945,675 A | | 8/1990 | Kendrick | 47/33 |
| 5,008,595 A | * | 4/1991 | Kazar | 315/178 |
| 5,045,981 A | | 9/1991 | Nagano | 362/219 |
| 5,103,382 A | | 4/1992 | Kondo et al. | 362/80.1 |
| 5,222,799 A | | 6/1993 | Sears et al. | 362/146 |
| 5,404,869 A | | 4/1995 | Parkyn, Jr. et al. | 126/699 |
| 5,430,627 A | | 7/1995 | Nagano | 362/146 |
| 5,463,280 A | | 10/1995 | Johnson | 315/187 |
| 5,495,147 A | | 2/1996 | Lanzisera | 315/185 |
| 5,499,170 A | | 3/1996 | Gagne | 362/84 |
| 5,594,628 A | | 1/1997 | Reuter et al. | 362/249 |
| 5,607,227 A | | 3/1997 | Yasumoto et al. | 362/249 |
| 5,613,769 A | | 3/1997 | Parkyn, Jr. et al. | 362/328 |
| 5,810,468 A | | 9/1998 | Shimada | 362/146 |
| 5,924,788 A | | 7/1999 | Parkyn, Jr. | 362/329 |
| 5,926,320 A | | 7/1999 | Parkyn, Jr. et al. | 359/641 |

(List continued on next page.)

FOREIGN PATENT DOCUMENTS

| | | | |
|---|---|---|---|
| EP | 0 660 648 A1 | 6/1995 | H05B/33/08 |
| WO | WO 98/21917 | 5/1998 | H05B/33/08 |
| WO | WO 98/26212 | 6/1998 | E21V/8/00 |
| WO | WO 99/06759 | 2/1999 | F21P/1/02 |

OTHER PUBLICATIONS

U.S. Application 09/334,848 filed Jun. 16, 1999 (Lighting Apparatus Having Low Profile).

(List continued on next page.)

*Primary Examiner*—Hoang Nguyen
(74) *Attorney, Agent, or Firm*—Kirkpatrick & Lockhart LLP

(57) ABSTRACT

An illumination apparatus comprises a lighting segment that includes a plurality of lighting sections. Each of the sections comprises a printed circuit board having a solid state optical emitter mounted thereon. The sections are interconnected by printed circuit board connectors, which serially position the printed circuit boards with edges of adjacent printed circuit boards proximate to each other. The connectors are deformable to alter the orientation in response to an applied force. The sections are electrically connected to each other such that the solid state optical emitters are electrically connected in series. The segment has a current regulator that controls current through the solid state optical emitter.

25 Claims, 11 Drawing Sheets

U.S. PATENT DOCUMENTS

| | | | | | |
|---|---|---|---|---|---|
| 5,931,577 | A | * | 8/1999 | Ishibashi | 362/800 |
| 5,941,626 | A | * | 8/1999 | Yamuro | 362/246 |
| 6,134,092 | A | | 10/2000 | Pelka et al. | 361/31 |
| 6,285,139 | B1 | | 9/2001 | Ghanem | 315/291 |
| 6,300,725 | B1 | | 10/2001 | Zinkler et al. | 315/291 |
| 6,313,589 | B1 | | 11/2001 | Kobayashi et al. | 315/309 |
| 6,371,637 | B1 | * | 4/2002 | Atchinson et al. | 362/555 |
| 6,473,554 | B1 | | 10/2002 | Pelka et al. | 385/146 |

OTHER PUBLICATIONS

U.S. Application 09/620,051 filed Jul. 20, 2000 (Lighting Apparatus).

William A. Parkyn, *The design of illumination lenses via extrinsic differential geometry*, (date unknown), 9 pages.

William A. Parkyn, *Segmented illumination lenses for step-lighting and wall–washing*, (date unknown), 8 pages.

Hewlett Packard catalog, Super Flux LEDs Technical Data, (date unknown), 3 pages.

Tivoli the light fantastic, (date unknown), 4 pages.

Tivoli escort lights, 1989©, 10 pages.

D. Jenkins et al., *Integral Design Methods for Nonimaging Concentrators*, J. Opt. Soc. Am. A., vol. 13, No. 10, Oct. 1996, pp. 2106–2116.

D. Jenkins et al., *Tailored Reflectors for Illumination*, Applied Optics, vol. 35, No. 10, Apr. 1996, pp. 1669–1672.

LumiLeds Product Showcase http://www.lumileds.com/products.html Oct. 11, 2000, 4 pages.

LumiLeds Red LED Rail Designer Kit, (date unknown), 5 pages.

* cited by examiner

FLEXIBLE LIGHTING SEGMENT

BACKGROUND OF THE INVENTION

1. Field of the Invention

The present invention relates to lighting, and more particularly to lighting that employs a plurality of solid state optical emitters such as light emitting diodes (LEDs).

2. Description of the Related Art

One form of signage commonly employed, both indoors and outdoors, is channel lighting. A canister or can comprising, for example, metal, and shaped in the form of a letter or character houses a source of light such as one or more fluorescent bulbs. The can has one translucent surface that also takes the form of the letter/character. When illuminated, light from the light source is transmitted through the translucent surface, creating a bright region in the shape of the letter or a character. The drawback to conventional channel lighting is that the fluorescent tubes bum out and require replacement; such replacement is inconvenient and costly. To overcome this problem, the fluorescent bulbs are currently being replaced with solid state optical emitters, such as LEDs, which are placed within the can. The LEDs, however, which are effectively point sources, create bright localized regions referred to herein as hot spots that are visible through the translucent surface. Such hot spots are distracting and aesthetically displeasing.

Thus, what is needed is a lighting apparatus for uniformly illuminating the channel light.

SUMMARY OF THE INVENTION

In one aspect of the invention, an illumination apparatus comprises a lighting segment which comprises a plurality of lighting sections. Each of the sections comprises a printed circuit board having a solid state optical emitter mounted thereon. The sections are interconnected by printed circuit board connectors, which serially position the printed circuit boards with edges of adjacent printed circuit boards proximate to each other. The connectors are deformable to alter the orientation in response to an applied force. The sections are electrically connected to each other such that the solid state optical emitters are electrically connected in series. The segments have a current regulator, which controls current through the solid state optical emitter.

In another aspect of the invention, an illumination apparatus comprises a lighting segment comprised of a plurality of electrically interconnected sections. Adjacent ones of the sections are flexibly connected to each other by connections, which permit relative movement therebetween. Each of the sections comprises a solid state optical emitter and an optical element. At least one optical element is a first refractive element and at least another optical element is selected from the group consisting of (1) a second refractive element having different refractive characteristics than the first refractive element and (2) an optical diverter having a total internal reflection surface.

Another aspect of the invention comprises a method of illuminating an elongate strip of translucent material. This method includes energizing a plurality of series-connected light-emitting diodes to emit light. Light is passed from the plurality of light-emitting diodes through a plurality of optical elements, respectively. Each of the plurality of optical elements produces an elongated pattern having a substantially uniform intensity across the pattern. The elongated illumination patterns are imbricated to substantially uniformly illuminate the elongate strip of translucent material.

In yet another aspect of the invention, an illumination apparatus includes a segmented support structure comprising of a plurality of sections, which are movably connected to each other. A plurality of point sources are mounted on the plurality of sections, respectively; and a plurality of non-rotationally symmetric lenses are mounted on the plurality of sections, respectively, to receive light from the plurality of point sources, respectively.

Each of the embodiments described above can be employed in connection with channel lighting, bandlights, and/or contour or accent lighting, for example, on buildings and other architectural structures. Bandlights are discussed in U.S. patent application Ser. No. 09/620,051 entitled "Lighting Apparatus" filed on Jul. 20, 2000, still pending, which is incorporated herein by reference. Applications of the above-described embodiments, however, are not limited to these.

DETAILED DESCRIPTION OF THE PREFERRED EMBODIMENT

Figure 1:
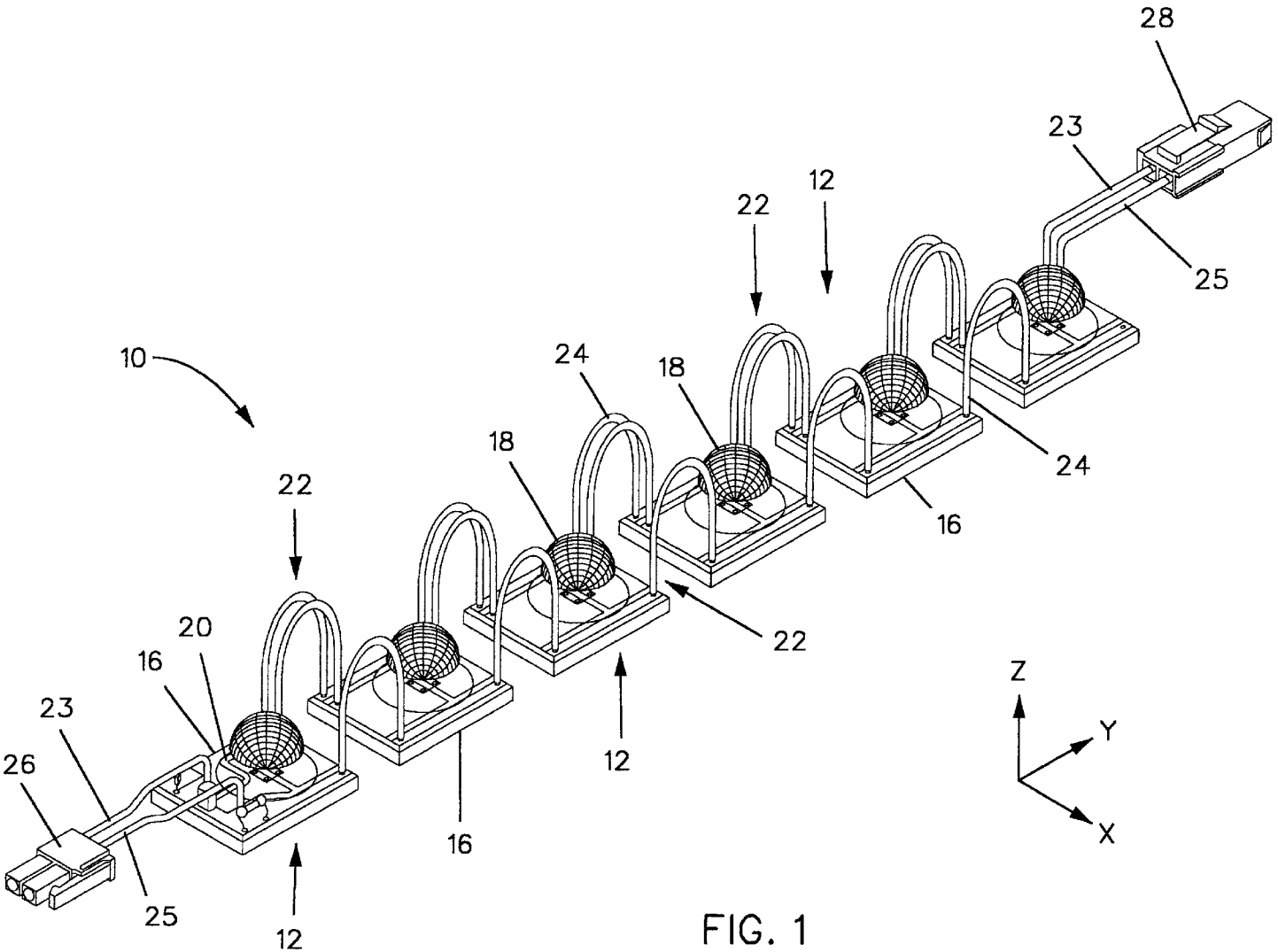
FIG. 1 is a perspective view of a flexible lighting segment comprising a plurality of solid state emitters, e.g., LEDs, each mounted on a separate printed circuit board (PCB), separated from each other but flexibly interconnected by electrical wiring.

As shown in FIG. 1, a flexible lighting segment 10 may comprise a plurality of lighting sections 12 flexibly interconnected. The lighting segment 10 may comprise, for example, three, four, five, six, or more such sections. Each section 12 includes a solid state optical emitter 14 (not shown) mounted on a base 16. The solid state optical emitter 14 may comprise a variety of solid state light sources such as laser diodes but preferably comprise light emitting diodes (LEDs). Such light emitting diodes may be semiconductor devices. Exemplary light emitting diodes comprise semiconductors such as AlInGaP, InGaN, and AlGaAs and are available from LumiLeds, Cree Inc., Nicha, UEC etc. Organic LEDs or other types of diodes known in the art or yet to be devised may also be used. Although LEDs are preferred, other sources of optical radiation may be employed in the alternative; however, LEDs offer the advantage of long life, bright output, high efficiency, and low cost.

The solid state optical emitters 14 may be outfitted with an optical element 18 such as a lens formed thereon or attached thereto. FIG. 1 shows a refractive optical element adhered to the LED 14 to control how light is emitted by the optical emitter. In this case, the optical element 18 is a segmented lens described in U.S. Pat. No. 5,924,788 issued to Parkyn, Jr. on Jul. 20, 1999, which is incorporated herein by reference. This particular optical element 18 has a plurality of surface normals selected to produce the desired output beam having the desired intensity distribution, e.g., a particularly high degree of uniformity. Accordingly, these segmented lenses can be customized for the particular application. Exemplary segmented lenses are available from Teledyne Lighting and Display Products of Hawthorne California and are sold under the trade name Black Hole™, Hammerhead™ and BugEye™. Other optical elements 18 for tailoring a beam output from the solid state emitter 14, both well-known in the art or yet to be devised, may otherwise be employed. Preferably, the optical element 18 is physically attached to the solid state emitter 14. The emitter 14 may be encased in substantially optically transparent material such as polymeric material or plastic, which preferably provides index matching and forms an optic conventionally referred to as a package. Various other techniques for positioning an optical element 18 in front of the light source 18 are also considered possible.

The solid state optical emitters 14 shown in FIG. 1 are attached to respective bases 16 here shown to be rectangular planar platforms in each section of the flexible lighting segment 10. These platforms 16 may comprise printed circuit board (PCB) or any other extended support structure that provides a base for the solid state optical elements 14. The printed circuit board 16 offers the advantage of including electrical pathways 20 to circuitry and for connecting electrical power to the solid state optical emitter 14. This printed circuit board 16 may be supplemented by other support or protective structures such as a frame (not shown), which is included with the lighting section 12.

As illustrated, each lighting section 12 is flexibly interconnected to at least one adjacent section via one or more flexible printed circuit board connectors or flexible interconnects 22. These flexible interconnects 22 are pliable and readily deformable such that the lighting sections 12 can be moved about in any direction, x, y, or z. For example, the lighting sections 12 can be stretched apart increasing the distance therebetween or the orientations of each section can be altered with respect to the other. Accordingly, the flexible lighting segment 10 can be stretched or expanded, bent or shaped or otherwise contorted to appropriately satisfy the need for the particular application. Preferably, the flexible interconnect 22 is also moldable such that the flexible interconnect after being deformed will retain its shape or remain deformed. Accordingly, the flexible lighting segment 10 can be shaped and/or expanded or compressed or otherwise adapted to suit the appropriate application and the individual sections 12 of the flexible lighting segment 10 will substantially retain their orientation and spacing with respect to each other. Preferably, the flexible interconnects 22 are sufficiently pliable to be deformed by hand with or without the aids of tools. Also, the flexible interconnects 22 should be such that they to not interfere with or block the emission of light from the solid state optical emitters 14.

The flexible interconnects 22 shown in FIG. 1 comprise electrical wire 24. This wire 24 can be bent but possesses a sufficient thickness so as to retain the bend after removal of the bending force. The wire 24 also serves to electrically connect the sections 12 of the flexible lighting segment 10 to each other. In this manner, electrical power can be supplied to the plurality of optical emitters 14. In one preferred embodiment, the wire 24 comprises insulated eighteen gauge wire, however, other sizes and types of wire may be used in the alternative. Any number and/or type of other suitable flexible interconnects 22 can be employed as well. Three wires 24 are show connecting adjacent lighting sections 12. More or less may be employed. In this case, three are selected to provide the appropriate electrical connection throughout the flexible lighting segment 10. The wires 24 should be of such length and nature that they do not interfere with or block the emission of light from the solid state optical emitters 14. The flexible connectors 22 are not, however, restricted to wires 24 and may be conducting or non-conducting. The interconnects 22 may, for example, comprise conducting or non-conducting strips, and may comprise nylon or delrin. Metal, being both conducting and ductile is a strong candidate. Insulation can also be provided. Other materials, inorganic or organic, are considered possible. The flexible lighting segment 10 is not limited to any particular type of flexible connector 22 and may include connectors not listed herein.

Extending from each end of the flexible lighting segment 10 is a pair of leads 23, 25 that are brought together and fit into in a standardized electrical connector 26, 28. These electrical connectors 26, 28 mate with other electrical connectors to allow the leads 23, 25 to be electrically connected to a similar pair of counterpart leads. These connectors 26, 28 thereby facilitate the connection of the flexible lighting segment 10 to other flexible lighting segments and to a power supply. The plurality of such flexible lighting segments 10 can therefore be concatenated together creating a long string of lights including as many as about 65 to 100 or more optical segments and as many as about 390 to 600 or more optical emitters 14. The electrical connectors 26, 28 also permit electrical power to be coupled to the plurality of flexible lighting segments 10. One connector 26, the one closer to the source of power, may be designated as an input connection with the other connector 28 referred to as an output connector, the voltage being transferred from the power supply to the input connector across the segment 10 to the output connector. The type of electrical connector 26, 28 is not restricted to any particular kind. Preferably, however, a male and female connector 26, 28 are provided for the input and outputs of the segments such that the segments can be readily connected together, preferably by simply snapping together or inserting within each other.

Preferably, these connectors 26, 28, have insulation to prevent shorts. One such connector 26, 28 may comprise a plastic or polymeric connector conventionally used in electrical devices.

Although not shown in FIG. 1, each section 12 has a fastener attached thereto enabling the lighting section to be secured to any number of objects or surfaces. For example, these fasteners permit the flexible lighting segments 10 to be fastened inside a lighting can for illuminating channel lighting. The lighting segment 10 is not limited, however, to this purpose and the fasteners therefore may be otherwise applied. This fastener may be connected to the base 16 of the lighting sections 12 or to an exterior such as a frame discussed above. The fastener may comprise double-sided tape, magnets, screws, bolts, and hooks. This list however is not inclusive as other different fasteners may be employed. Glue, cement or other types of adhesives may also be used to adhere the lighting segment 10 to a particular surface.

Figure 2:
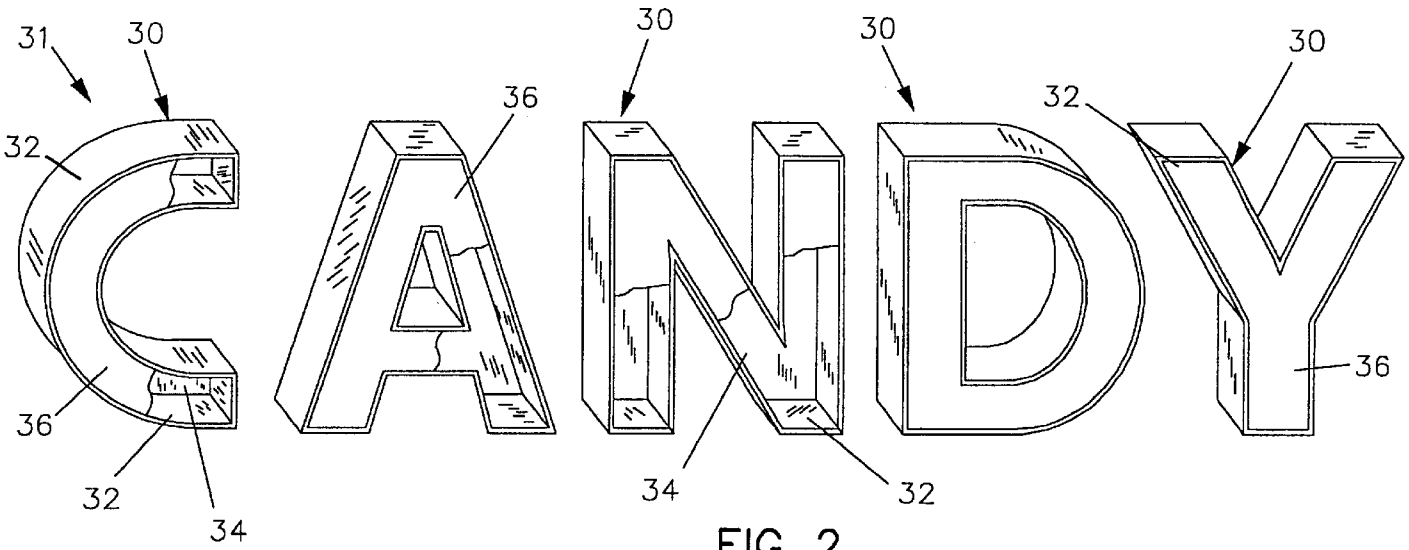
FIG. 2 is a perspective view of a sign comprising block lettering formed by channel lighting.
Figure 3:
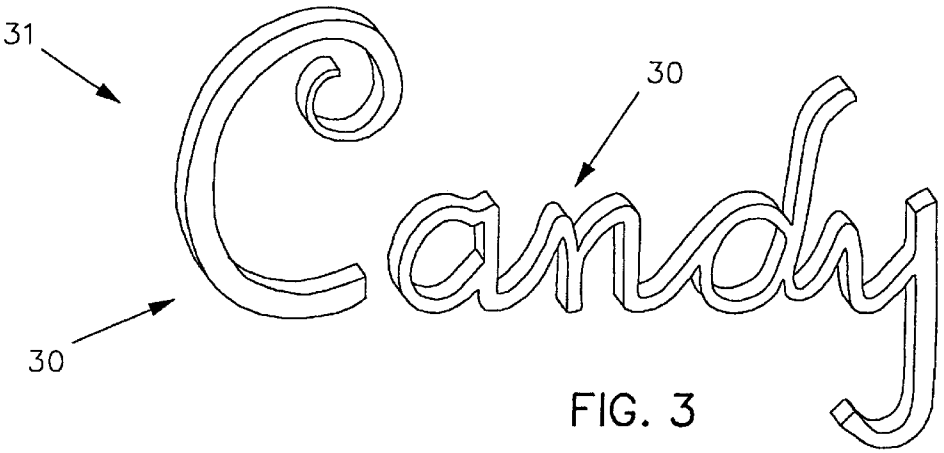
FIG. 3 is a perspective view of a sign comprising channel letters of a different font.

As shown in FIGS. 2 and 3, channel lighting 31 can take on a variety of forms including block lettering (FIG. 2) and other stylistic fonts (FIG. 3). Exemplary channel lighting 31 comprises a can 30 having sidewalls 32, a base or floor 34, and a front substantially optically transmissive sheet or surface 36 that forms an enclosure in which the light sources, such as one or more of the flexible lighting segments 10 described above, can be housed. The channel light 31, and accordingly the sidewalls 32, floor 34, and front translucent surface 36, are shaped in the form of the desired character or letter. The sidewalls 32 and floor 34 of the can may comprise various materials including, for example, metal and plastic, which are commonly employed. The front substantially transmissive surface or panel 36 may comprise colored plastic or glass. This front panel 36 may also include a holographic optical element (HOE) or other diffractive optical element; such elements can be place in front of or behind the front panel to control light transmitted therethrough. More preferably, the HOE is placed next to the front plastic or glass surface 36 inside the channel letter 30 or bandlight. Other materials may also be employed, however, preferably this front surface 36 allows light to be transmitted therethrough so that the channel lighting 31 takes the form of a luminous strip, character, or letter. The color of the front substantially transmissive surface 36 is not limited and may be red, white, blue, green, or virtually any color imaginable. This front substantially transmissive surface 36 is preferably translucent and is diffusing, i.e., it diffuses the light from the light source within the can 30 and may comprise a diffuser such as a holographic diffuser. Further, the interior of the can 30, i.e. the inside sidewalls 32 and floor 34, are preferably diffusing as well. The surfaces may, for example, be coated with white diffusive or otherwise reflective paint preferably with a diffuse reflectivity in excess of 92% or other materials that create a reflective/diffusive surface. Accordingly, light emanating from the light source within the can may be scattered randomly from the diffusive surfaces of the interior of the can 30. Although some specific details of the can design have been described herein, the flexible lighting segment 10 need not be limited to any particular channel lighting design.

One reason the flexible lighting segment 10 is advantageous for use in channel lighting 31 is that the lighting sections 12 can be arranged in any manner and situated in any location and therefore enable illumination if desired to be uniformly distributed within the can. Uniformly bright channel lighting is problematic with various characters, letters and fonts. Some regions of the channel light 30, for example, may appear brighter or darker when conventional fluorescent lighting is employed. Certain regions where portions of the channel light 30 converge may appear brighter, while other regions which are wide may be dimmer. To counter these effects, the flexible lighting segment 10 enables a higher concentration of lighting sections 12 and optical emitters 14 to be placed in regions that tend to be dimmer and higher spacing between such lighting sections in regions that would otherwise be too bright. Similarly, spacing can be reduced for lower intensity optical emitters such as white LEDs or the separation can be increased for brighter sources such as red LEDs. The spacing may range, for example, up to about from 1.5 to 3.0 inches between the centers of adjacent optical emitters 14 and up to about 18 inches between the segments 10, depending on the size of the segments. The spacing, however, may be outside these ranges. In one embodiment, the bases 16 are attached together and can be snapped apart and separated from each other.

Figure 4:
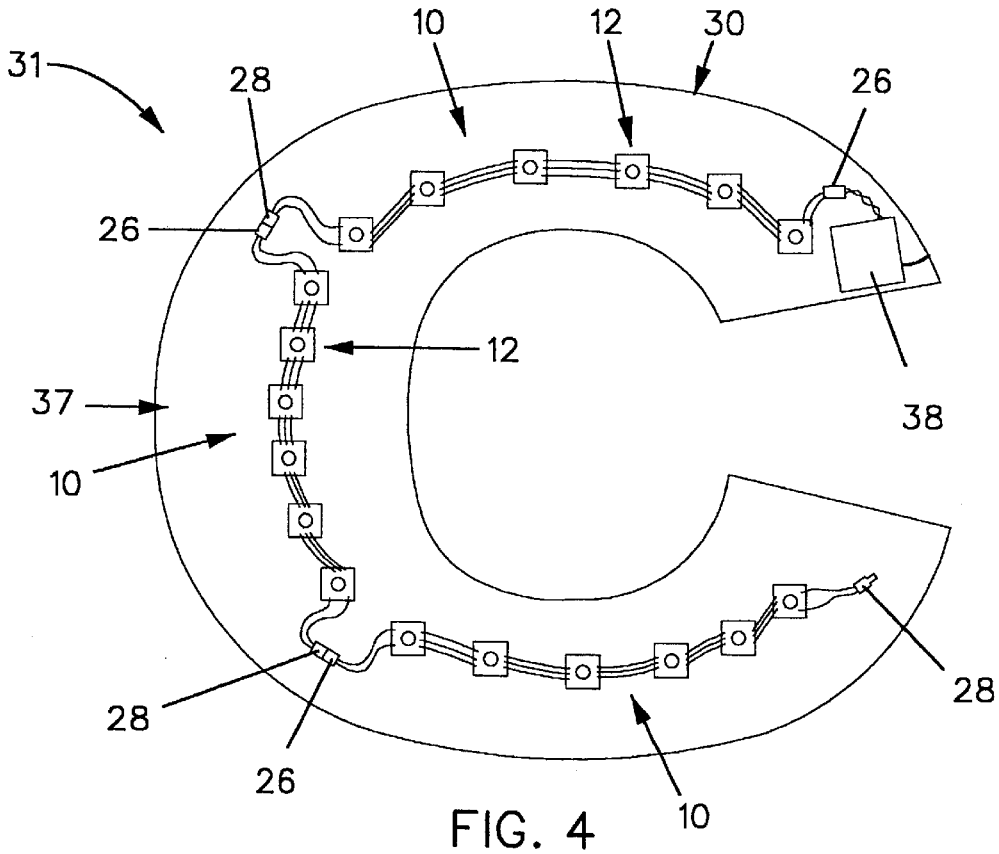
FIG. 4 depicts a top view of an exemplary channel light showing a plurality of flexible lighting segments strung together using electrical connectors.

To illuminate the channel letters 30, the flexible lighting segments 10 are inserted within the channel lighting 31 as shown in FIG. 4 and preferably positioned therein to provide the desired lighting effect, such as, for example, uniform lighting. Other lighting effects may also be created as desired, for example, non-uniform lighting may be desirable to create different results, such as shadowing, or to implement other styles. In addition, multicolor sources, such as red (R), green (G) and blue (B) LEDs may tied to a power supply controlled by a microprocessor such that individual colors can be energized separately or together to produce either red, green, or blue or any other colors of the spectrum within the CIE triangle of RGB sources. Accordingly, the flexible lighting segment 10 is advantageous in enabling the lighting 31 to be customized to create the desired aesthetic effect. The flexible lighting segment 10 may be, for example, expanded and bent to follow the shape of the character and be placed and fastened to the floor 34 of the channel lighting 31, such that the optical output is directed upwards toward the substantially transmissive surface 36. The spacing and orientation of each lighting section 12 with respect to the other may be appropriately selected to follow the shape of the letter, such that, e.g., uniform illumination is provided across the front face 36 of the letter or character. A plurality of flexible lighting segments 10 can be concatenated or serially connected to provide the appropriate number of light sources within the channel letter 30 for sufficient brightness. In such cases, the flexible lighting segments 10 are electrically connected together using the electrical interconnects 22 described above to carry power to each of the flexible lighting segments. The resultant product comprising the plurality of flexible lighting segments 10 electrically connected together is herein referred to as a flexible lighting assembly 37. The spacing between the lighting sections 12 may not be uniform and in particular may be increased or decreased to provide the appropriate amount of light necessary within the channel light 30. Features of the character, letter, or strip to be illuminated may influence this separation.

Electrical power is supplied to the chain of flexible lighting segments 10 by electrically connecting to a supply line of power using the standardized electrical interconnects 26, 28 described above. Power may be in the form of AC or DC voltage. For example, DC voltage, preferably a low DC voltage between about 24 and 27 volts can be carried to the channel lighting 31 using electrical cables. In FIG. 4, a power supply 38 is contained within the can 30. AC power can be delivered to the can 30, which includes a DC converter or switcher that converts the AC power signal into a DC volt signal. Other arrangements wherein AC or DC power is provided, are also envisioned.

Figure 5:
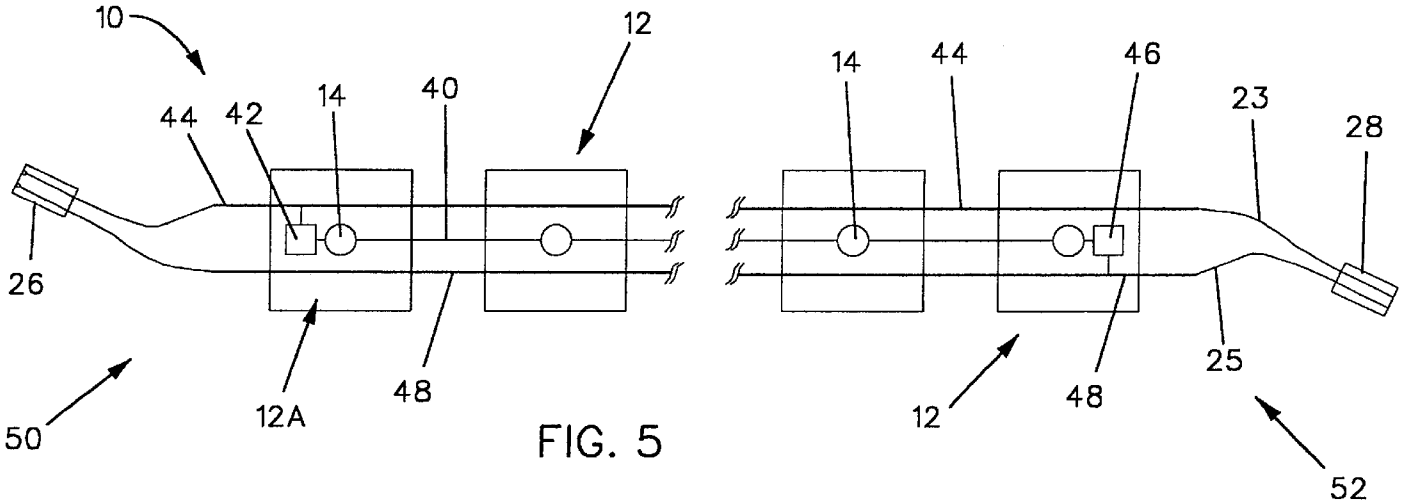
FIG. 5 is a schematic block diagram that shows the lighting segment comprising a plurality of lighting sections electrically connected together.

Light emitting diodes and various other solid state optical emitters 14 radiate light when supplied with electrical current. The intensity or brightness of the optical output from the LED 14 depends on the amount of current driven through the LED. As shown schematically in the block diagram of FIG. 5, a regulated current line 40 flows through the plurality of LEDs 14 in the flexible lighting segment 10. A current regulator 42 electrically attached to this line 40 provides a substantially constant supply of current to these light sources 14. This regulator 42 may comprise other types of current sources 14 that preferably provide a substantially fixed level of current to the light emitting diodes 14, one example, however, comprises a model LM 317 current regulator 42 available from National Semiconductor. The current regulator 42 is powered by a DC voltage supply line 44, which, in one preferred embodiment, carries between approximately 24 to 27 volts DC, however this range should not be construed as limiting. Other voltages may be employed. The solid state optical emitters 14 are strung in series to allow the same regulated current to drive each. This current may range between about 30 milliAmpere (mA) to about 50 mA and in one embodiment is about 40 mA, but the current is not limited to these values. The last solid state optical emitter 14 in the series included in the flexible lighting segment 10 is electrically connected to electrical components 46 tied ground 48. These electrical components may comprise diodes, resistors, or other devices and preferably provide the appropriate LED voltage drop across the regulator.

The DC voltage supply line 44 that powers the current regulator 42 is continued through the flexible lighting segment 10 and terminates at the output connector 28 for attachment to additional lighting segments to provide power thereto. Accordingly, this DC power line 42 may be referred to as a "voltage bus" since it extends through each segment 10 in the flexible lighting assembly 37. Each segment 10 also includes a ground line 48 that runs from the input connector 26 to the output connector 28 and continues through the plurality of segments in the lighting assembly 37. Although this ground line 48 extends through each of the segments 10 of the flexible lighting assembly 37, other ground connections or substitute ground lines may be provided; for example, each lighting segment can be ground to the can 30 in the case where the can is conducting. Preferably, however, the voltage bus 44 extends throughout the flexible lighting assembly 37 being continued from one segment 10 to the other via electrical connectors 26, 28.

The electrical pathway for the voltage bus 44 and the ground line 48 may be provided by wiring extending from the input and output connectors 26, 28, conductive pathways 20 on the printed circuits boards 16 and electrical wire 24 connecting the PCBs together. The electrical wiring 24 between the printed circuit boards 16 may correspond to the flexible interconnect 22 between the adjacent sections 12. Thus, the voltage can be established from the input connector 26 to the lighting section 12A on the proximal side 50 of the flexible light segment 10 sequentially to each lighting segment 12 until the distal end 52 the flexible lighting segment is reached. From there, the electrical leads leading 23, 25 to the output connector 28 carry the voltage to the next segment 10. Conductive pathways 20 on each of the printed circuit boards 16 permit the voltage to be transferred across the lighting section 10. The wires 24 comprising the flexible interconnect 22 permit the voltage to be transferred from one section 12 to the next section.

More particularly, the wiring 23 from the input connector 26 is electrically connected to a conducting pathway 20 on the printed circuit board 16 in the lighting section 12 on the proximal end 50 of the segment 10. This conductive pathway 20 preferably extends across a substantial portion of the printed circuit board 16, for example, from the proximal end 50 closer to the input electrical interconnect 26 to the distal end 52 closer to the next lighting section 12. Wire 24 in the flexible interconnect 22, e.g., the cathode or unregulated cathode, may be electrically connected to a portion of the conductive pathway 20 preferably towards the distal end 52 and near the adjacent lighting section 12. This wire 22 extends to the second lighting section 12, and in particular, to a conductive pathway 20 within the printed circuit board 16 in this second section 12. One of the electrical wires 24 in the flexible interconnect 22 contacts this conductive pathway 20 to continue the voltage bus 44 through to the second section 12 of the lighting segment 10. In this same manner, the voltage bus 44 is continued on through the series of lighting sections 12 from the proximal end 50 of lighting segment 10 to the distal end 52. One of the electrical leads 23, 25 attached to the output electrical connectors 28 is soldered or otherwise electrically contacted to the appropriate conductive pathway 20 on the PCB 16 in the distal-most lighting section 12. The voltage may therefore be continued to the next lighting segment 10. The ground line 48 is similarly propagated through each of the lighting sections 12 in the flexible lighting segment 10 and may run from the input connector 26 to the output connector 28 to continue the ground line 14 through the plurality of flexible lighting segments 10 in the lighting assembly 37.

As discussed above, the current regulator 42 which controls the current to the solid state optical emitters 14 is powered by the DC voltage contained in the voltage bus 44. By using a current regulator 42, a regulated or fixed supply of current can be provided to the emitters 14; this ensures that the brightness is substantially constant. In one embodiment, the current regulator 42 is mounted on the printed circuit board 16 in the first lighting section 12A at the proximal end 50 of the lighting segment 10. The electrical pathway for the regulated current line 40 may be provided by conductive pathways 20 on the printed circuit boards 16 to the input of the solid state optical emitter 14 and from the output of the emitter to wiring 24 between adjacent lighting sections 12. The electrical wiring 24 connecting the printed circuit boards 16 may correspond to the flexible interconnect 22 between the adjacent sections 12. Thus, the regulated current 40 can be carried from the current regulator 42 to the input of the solid state emitter 14 on the proximal side 50 of the flexible light segment 10 sequentially to the optical emitter in each lighting section 12 until the distal end 52 the flexible lighting segment 10 is reached. Conductive pathways 20 on each of the printed circuit boards 16 therefore preferably permit the current to be transferred across a given lighting section 12, to and from the solid state emitter 14. Wires 24 possibly coinciding with the flexible interconnect 22, permit the current to be transferred from one section 12 to the next section. The regulated current, however, is not carried through the output connector 28 to the next lighting segment. Instead, the DC voltage bus 44 runs through the plurality of segments 10 in the flexible lighting assembly 37 and powers current regulators 42 contained within the separate segments.

Figure 6:
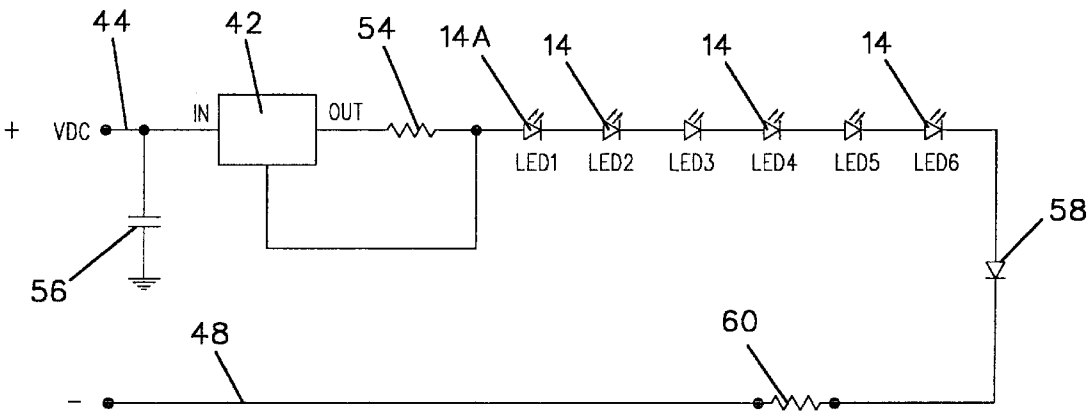
FIG. 6 is a circuit schematic showing LEDs connected in series to the output of a current regulator as in the flexible lighting segment of FIGS. 1 and 5.

As shown by the circuit schematic of FIG. 6, the plurality of solid state optical emitters 14 are connected in series to the output of the current regulator 42. A resistor 54 is inserted in the path between the current regulator 42 and the first light emitting diode 14A for purposes of establishing a feedback voltage to the current regulator to maintain a substantially fixed output current. As described above, the current regulator 42 is powered by a DC voltage, in one embodiment about 27 volts. The actual voltage supplied may vary depending, for example, on the type of current regulator 42 or other regulated current output device. An AC blocking capacitor 56, e.g., 0.1 MegaFarad, is shunted between the voltage bus 44 and the ground 48 at the input of the current regulator 42 to prevent regulator oscillation. As discussed above, the last solid state optical emitter 14, here denoted LED 6, is followed by a diode 58, an IN4002 model, available from Newark, Los Angeles Calif., and a resistor 60, in the one embodiment, a 50 ohm resistor that established the appropriate LED voltage drop across the regulator. This configuration is specifically suitable for certain types of amber and red diodes. A similar configuration for certain types of green, blue and white diodes may also be employed wherein the resistor 60 connected to ground is substituted by a jumper and the resistor 54 at the output of the current regulator 42 is a 42 ohm resistor instead of a 30 ohm resistor. The specific electrical components, however, may vary depending upon the circuit design, the number of optical emitters 14, and the particular application. Other electrical configurations can be employed, preferably, however, the solid state emitters 14 are connected in series and a regulated or set current is supplied to each.

In one embodiment, a plurality of these flexible lighting segments 10 are electrically connected together via the respective input and output electrical connectors 26, 28 and the resultant flexible lighting assembly 37 is electrically connected to a source of DC power, for example, in the range between about 24 to 27 volts DC. Together these flexible lighting segments 10 can be inserted in a can 30 of a channel letter. A DC power supply, which may comprise a switcher for converting AC line voltage into the appropriate DC voltage for powering the flexible lighting assembly 10, may also be included. When activated, DC voltage to the current regulators 42 will produce a regulated current that is driven through each of the solid state optical emitters 14 in each of the segments 10. The DC voltage is carried through the voltage bus line 44 to each flexible lighting segment 10, which are preferably electrically connected in parallel such that the voltage supplied to each segment 10 is substantially the same. This DC voltage is interconnected to the current regulator 42 within each segment 10, thereby providing power that is converted into a regulated current that is driven through each solid state optical emitter, i.e., LED, 14 within each flexible lighting segment. Because the solid state emitters 14 are in series, they receive the same amount of current and are the same brightness; the brightness of the emitter depending directly upon the amount of current provided thereto. Feedback to the current regulator 42 aids in obtaining a substantially set predetermined output current to the LEDs. A regulated current permits the brightness to be maintained at a specific level.

Light emitted by the solid state optical emitter 14 passes through the optical element 18, which provides a suitable beam for the desired application. Preferably, this optical element 18 controls the direction and intensity distribution of light emitted by the solid state optical emitter 14, e.g., into the can 30. A beam emanating from the emitter 14 can be shaped; divergence and uniformity controlled and direction of output established. This optical element 18 preferably comprises a lens; this lens may be a conventional refractive lens or may comprise other types of refractive optical elements. This lens 18 may be a diffractive element, a total internal reflectional lens, or a reflective optical element such as a mirror, shaped appropriately to provide a desired beam. Preferably, the optical element 18 comprises a nonimaging optical element. Nonimaging optical elements are well-known; see, e.g., *Integral Design Methods for Nonimaging Concentrators*, D. Jenkins and R. Winston, J. Opt. Soc. Am. A., Vol. 13, No. 10, October 1996, pp. 2106–2116 and *Tailored Reflectors for Illumination*, D. Jenkins and R. Winston, Applied Optics, Vol. 35, No. 10, Apr. 1, 1996, pp. 1669–1672. These nonimaging optical elements may be reflective, refractive, or diffractive optical elements. Other types of optical elements 18 may be employed to provide the desired optical emission from the solid state optical emitter 14.

To illuminate a channel letter 30, the optical elements 14 may be directed toward the front, substantially transmissive panel or surface 36, the sidewalls 32, or the base 34 of the channel letter. Similarly, the lighting sections 12 may be mounted on the sidewalls 32 or the base 34. In some embodiments, the lighting section 12 may be mounted on the base 34 and the optical emitter 14 tilted toward the sidewalls 32, or vice versa, with the lighting section mounted on the sidewalls and the optical element being tilted toward the base or the front translucent sheet 36. In the case where optical emission is directed towards the sidewalls 32 or the base 34, preferably the sidewalls and/or base are diffusely reflective; they may contain for example white or otherwise diffusely reflecting paint or layers formed thereon or be made of a diffusely reflective material.

Figure 7:
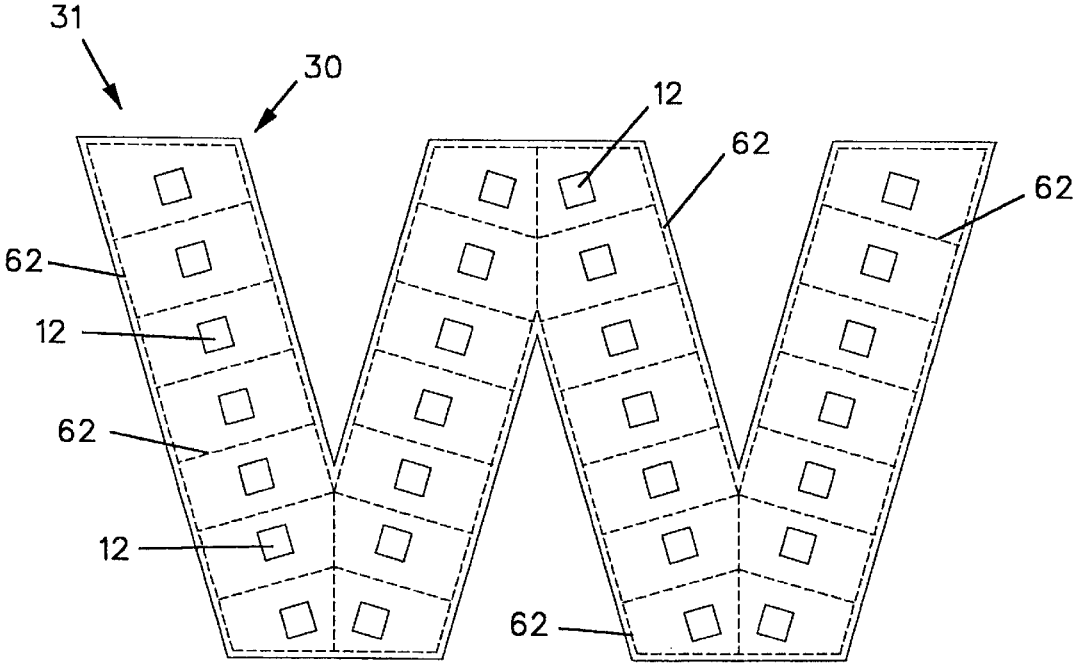
FIG. 7 is a schematic illustration that shows the distribution of light from each of the LEDs on the translucent surface of the channel light.

In some preferred embodiments such as when the flexible lighting segment 10 is mounted on the base 34 of the channel letter 30 and the optical output from the letters is directed onto the substantially transmissive front panel 36, light radiated from the optical emitter 14 spreads out or diverges enabling an enlarged spot to be projected onto a larger area of surface. As a variety of types and sizes of channel letters 30 may be outfitted with the segmented lighting assembly 37 described above, the angle of divergence or spread of the beam output from the lighting section 12 is not limited to any particular angle but instead may range in angles, for example, between about ±5° to ±90°, or more or less. For example, channel letters 30 may for example be 2–3" deep, 5–6" deep, 8–12" deep, etc. and may have various widths depending upon the type of letter and font. Alternatively, letters approximately 5 feet high with spaces about 27 inches wide are also possible. In such configurations, a far field pattern is formed on one of the surfaces of the can 30 such as, for example, the front translucent panel 36. This pattern may be substantially elliptical, square, rectangular, or may take other shapes. The optical element 18 may be selected appropriately to produce the desired shape. These shapes may or may not be rotationally symmetric. These patterns may be elongated having a larger dimension in one direction than another, possibly perpendicular, direction. For example, the pattern may be substantially rectangular having a width and a length wherein the length exceeds that of the width, or vice versa. Such patterns may be created by beams having divergences that vary in two directions. For example, the spread may be ±60° in the horizontal direction and ±25° in the vertical direction. Preferably, the lighting sections 12 are positioned such that the far field patterns created by each lighting section fills a portion of the front panel 36 of the channel letter 30. In cases where uniformity is desired, these far field patterns are imbricated or tiled so as to distributed light throughout the surface of the front panel 36 substantially avoiding excessive overlapping of the beams. As shown in FIG. 7, in some cases the light projected on the panel 36 may comprise elongated patterns 62 narrow and long to substantially fill a portion of the channel lettering 31.

A plurality of lighting sections 12, each containing a similar or different optical element 18 can provide such projected patterns 62 which together substantially uniformly illuminate a large portion of the letter 30, preferably the entire letter. The far field patterns 62 illustrated in FIG. 7 illuminate a section of the front translucent panel 36 from sidewall 32 to sidewall. Some of these far field patterns 62 may overlap, however, preferably the overlap is not so significant as to create nonuniformities or hot spots in brightness, which disrupt the uniformity. Preferably, the uniformity over the channel letter 30, which can be defined as the difference between the maximum brightness and the minimum brightness divided by the sum of the maximum and minimum brightness, i.e., (max−min)/(max+min), is less than or equal to about 10%, or at least less than or equal to about 40%. Accordingly, both within a single beam or projected spot on the front panel 36 as well as over a distance that spans a multiplicity of such spots, the uniformity is less than or equal to 10% and more preferably less than or equal to 5% but may be less than or equal to 40%. Preferably, this uniformity is maintained over the far field pattern 62, a larger section of the channel light comprising a plurality of such far field patterns, or even over the entire luminous portion of the channel letter 30 as seen by a viewer.

Note that the optical elements 18 may be the same or different in each section 12 or segment 10 possibly providing different far field patterns 62. Such variation may be necessary to fill irregularly shaped regions in a letter or character. In some preferred embodiments, the flexible lighting segment 10 is outfitted with a single type of optical element 18, but different segments containing different optical elements are linked together to properly illuminate the channel letter 30. Variations in fonts may be accommodated with possible variations in separation and positioning of the lighting sections 12 and/or use of different optical elements 18. For example, in thinner regions of the letter or character, the optical element 18 that yields a smaller angle of divergence may be selected and/or the separation between adjacent lighting sections 12 may be increased to ensure that the intensity is not too large. The shape of the far field pattern 62 may also be varied by substitution of the optical element 18.

Although the pattern 62 shown in FIG. 7 is substantially rectangular, this pattern may have other shapes such as, for example, substantially elliptical, substantially circular, or otherwise shaped. In addition, although a single lighting section 12 is shown for a given width across the channel letter 30, more than a single section can be used to illuminated the width of the can. For example, one or more flexible lighting segments 10 can be positioned alongside each other over the length of at least a portion of the can 30.

Figure 8A:
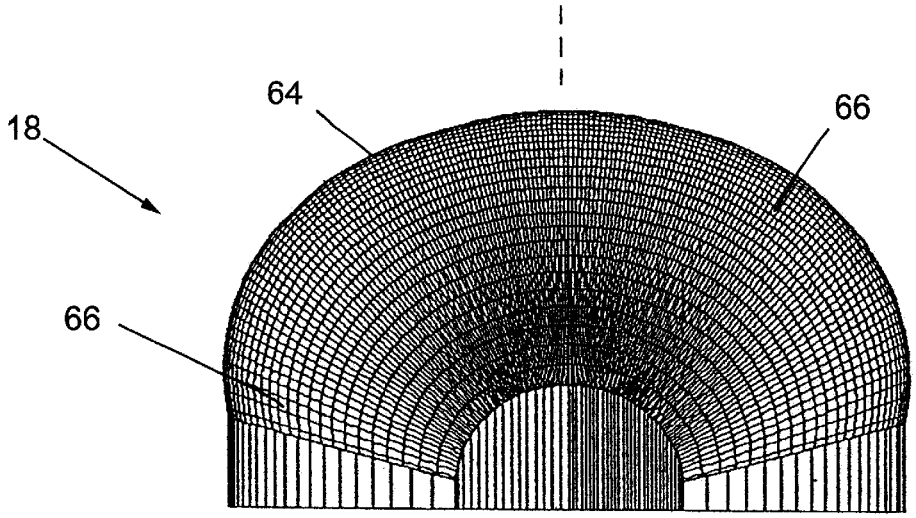
FIGS. 8A and 8B are perspective views of an exemplary optical element, herein referred to as a segmented lens, that is shown in FIG. 1.
Figure 8B:
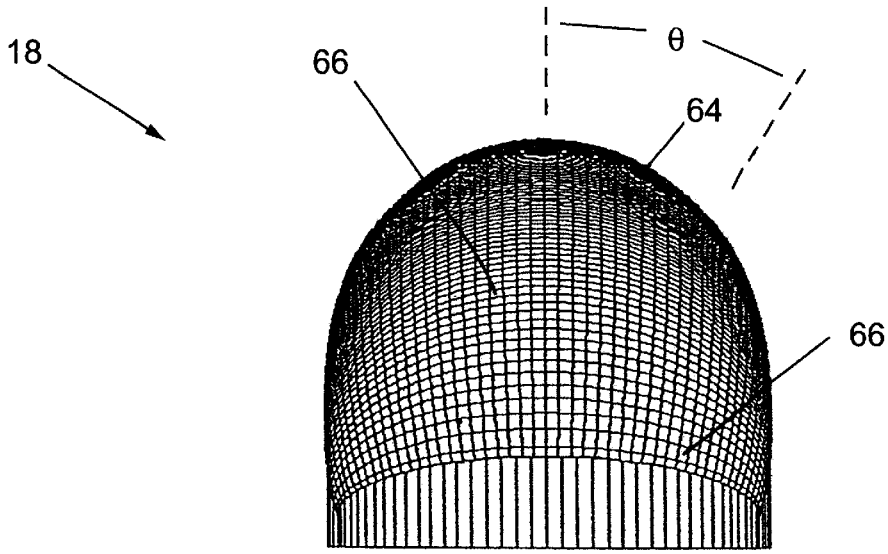

An optical element 18 that can be tailored to provide an elongated far field pattern 62, such as en ellipse, square, or rectangle etc., is shown in FIGS. 8A and 8B. This optical element 18 is also the one included in the embodiment depicted in FIG. 1 and is described in U.S. Pat. No. 5,924,788, issued to Parkyn, Jr. on Jul. 20, 1999. This lens 18, herein referred to as a segmented lens, has a curved refractive surface 64 comprising a plurality of surface normals as shown in U.S. Pat. No. 5,824,788. Each portion of the curved refractive surface 64 may comprise a surface or facet that may be angled with respect to adjacent portions and other portions on the refractive surface. The solid state emitter 14 may be placed at the base of the segmented lens 18. Light emitted by the solid state emitter 14 is received by this segmented lens 18 is transmitted therethrough and refracted by the facets on the surface 64 of the segmented lens 10 so as to create the appropriate beam shape.

The faceted portions of the refractive surface 64 are specifically oriented to map the output of the solid state emitter 14 into the appropriate far field radiation pattern 62. This pixelation of the refractive surface 64 on the lens 18 is designed specifically to tailor the optical output for the particular application. The plurality of portions can be angled appropriately to provide and shape the beam as desired. Computer simulations may aid in the design this particular type of lens 18. This lens 18 can also be specifically designed to provide the appropriate divergence angle, θ, or to match this angle's with the channel letter 30 in which it is inserted. For example, for channel letters 30 having narrow width and/or that is deeper a narrow divergence is provided; for a channel letter having a larger width and/or shallower depth, a wider divergence is provided.

This lens 18 also can be tailored to provide the appropriately shaped far field pattern 62, for example, the pattern can be made to be substantially square, rectangular, or elliptical. Other shapes may be provided as well, and are selected to suit the shape of the letter or character. This lens 18 is non-rotationally symmetric in shape, but may be symmetric about one or two axes. Similarly, the far field pattern 62 produced by such a lens 18 may also be non-rotationally symmetric, i.e., a non-circular spot, especially in the case when the lens itself is non-rotationally symmetric. Alternatively, the lens 18 and/or the resultant far field pattern 62 may be rotationally symmetric as well. This lens 18 is specifically useful for matching far field patterns 62 with highly irregular shapes. Moreover this lens 18 can control the intensity distribution throughout that far field pattern 62.

Figures 9, 10:
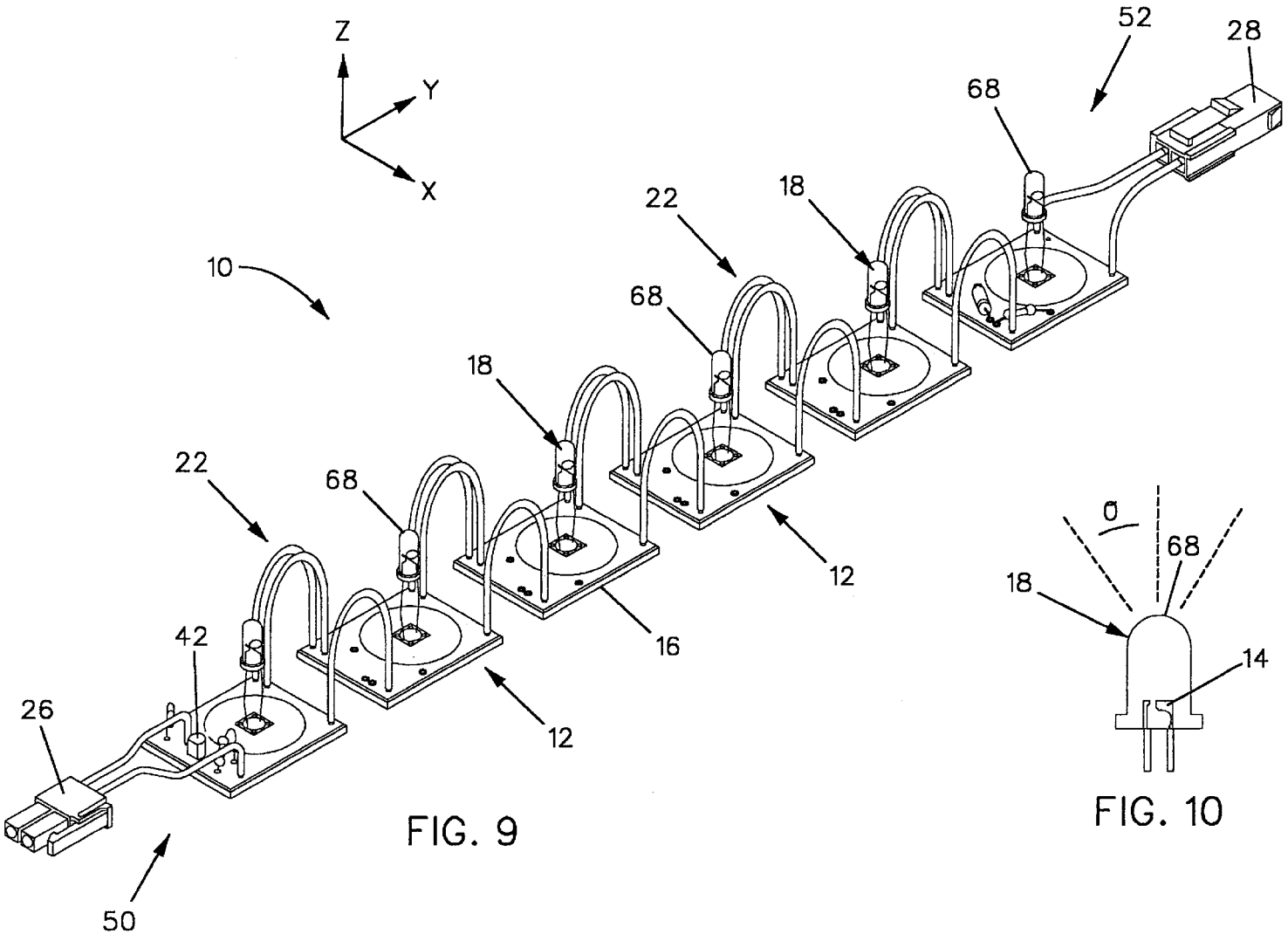
FIG. 9 is a perspective view of another embodiment of the flexible lighting segment comprising LEDs having conventional bullet-shaped packages lenses.
FIG. 10 is a cross-section of the LED of FIG. 9 depicting how a cone of light emanates therefrom.

In lieu of providing a customized optical element 18, the solid state emitter 14 may comprise a standardized bullet-shaped lens shown in FIGS. 9 and 10. Substantially transmissive material such as for example a polymeric material like acrylic, polycarbonate, silicon etc. is formed over the light emitting solid state device 14 and is shaped to create a curved refractive surface 68 in front of the lens. The result is a solid state optical emitter 14 encased in a shaped polymeric material configured like a bullet. An example of such a conventional LED package is the T 1-3/4 LED available from Alpine Tech, Irvine Calif., e.g., model number ATI5B14QT4. When activated, light output by the optical emitter propagates through the substantially transmissive material and is refracted at the curved surface 68. This package, which is rotationally symmetric about a central axis, produces a conical output having a beam divergence typically between about 15° to 60°. The far field pattern 62 is rotationally symmetric, i.e., a substantially circularly-shaped spot is projected onto a plane in the far field surface. Other bullet lenses 18 may be non-rotationally symmetric and may produce elliptical far field patterns. Such non-rotationally symmetric bullet-shaped lenses 18 can also be employed in the flexible lighting segments 10 like the one shown in FIG. 9.

Figures 11, 12:
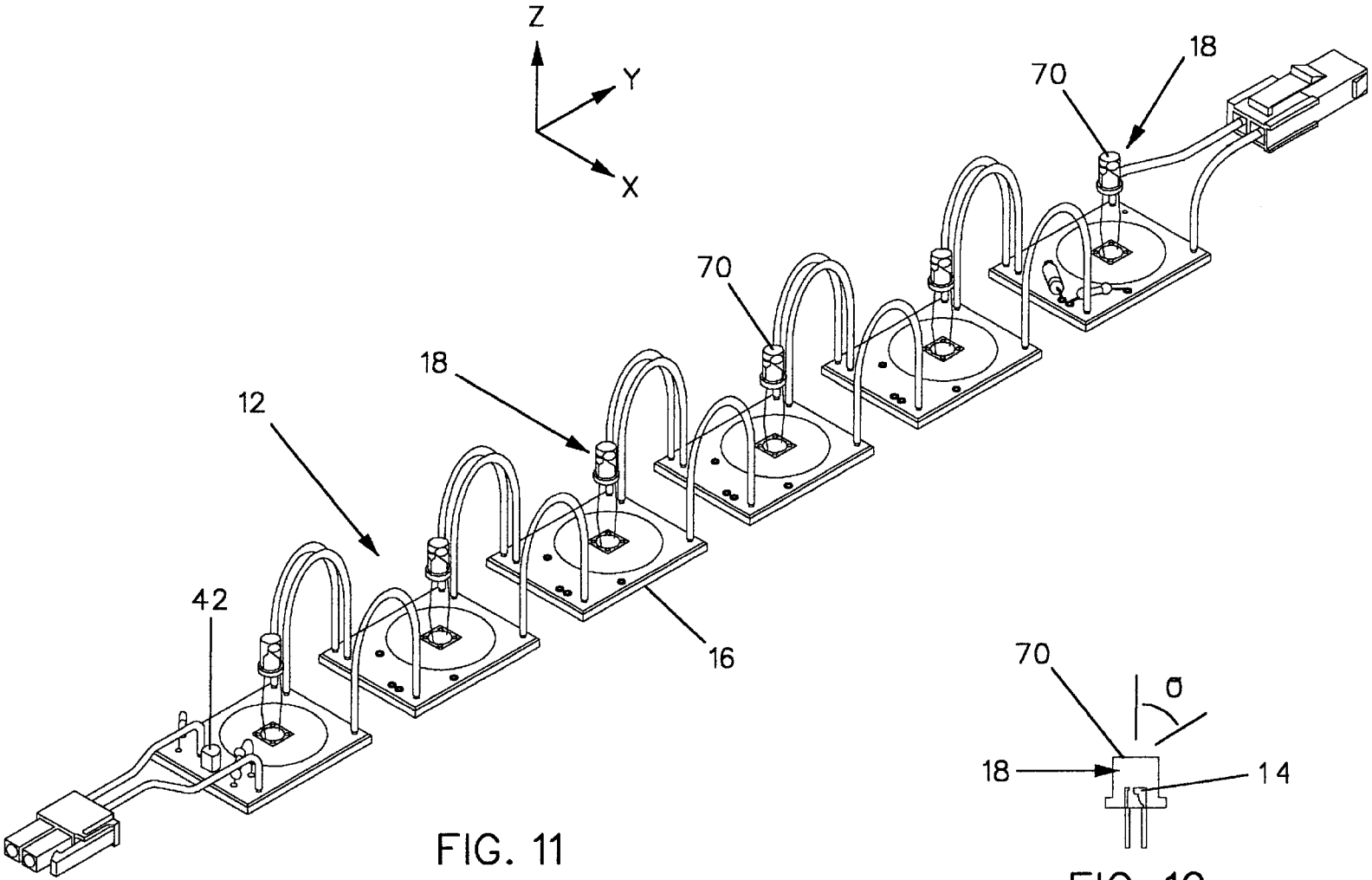
FIG. 11 is yet another embodiment of the flexible lighting segment wherein the LED has a flat top.
FIG. 12 is a cross-section of the LED of FIG. 11 depicting how a cone of light emanates therefrom.

Alternatively, the optical element included in the flexible lighting segment 10 may have a flat refractive surface 70 on top as shown in FIGS. 11 and 12. This type of solid state emitter package is referred to herein as a "flat top." Like the bullet lens, this optical element 18 comprises a substantially optically transmissive material such as a polymeric material like polycarbonate, acrylic, or silicone. This solid state optical emitter 14 is imbedded in this material. Instead of having a curved front surface 68, the substantially optically transmissive material has a flat surface 70 for refraction of light therefrom. This device emits a conical shaped beam having a wide divergence angle, θ, ranging from about 145 to about 165 degrees. This device is circularly symmetric and the far field pattern 62 it creates is also circularly symmetric. This pattern 62 may comprise a substantially circular spot that is projected in the far field plane. This optical element 18 may find use in channel letters or characters 30 that are shallow and/or wide, such as a cans 30 about from about 4 to about 36 inches wide and from about 5 to about 12 inches deep.

Figures 13, 14:
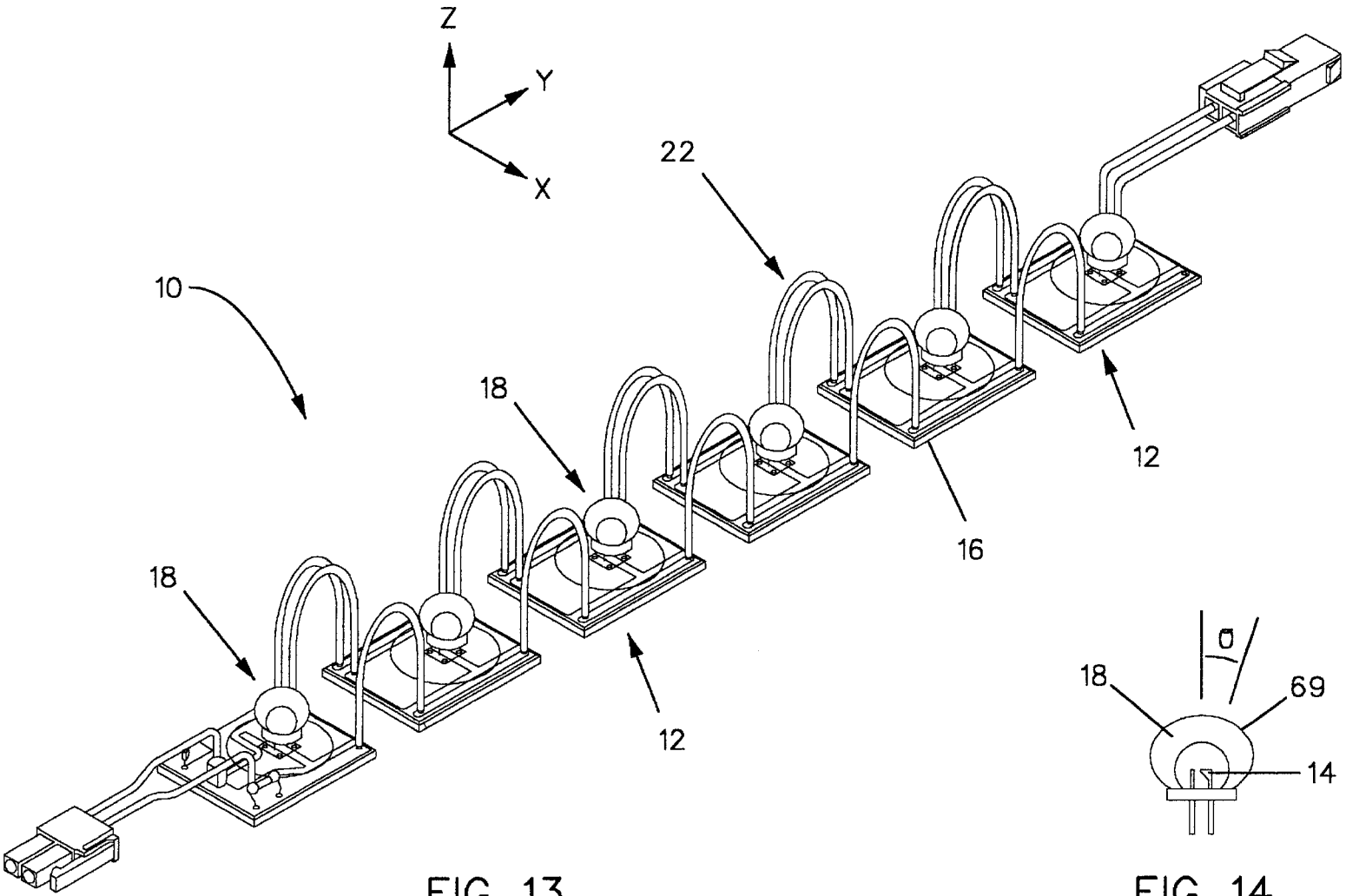
FIG. 13 is another embodiment of the flexible lighting segment, wherein the optical element above the LED comprises a lens having a refractive surface customized to provide uniform intensity in the far field and referred to as a BugEye™ lens.
FIG. 14 is a cross-sectional view of one of the BugEye™ lenses of FIG. 13 showing a cone of light emanating therefrom.

Another circularly or rotationally symmetric optical element that can be positioned in front of the solid state optical emitter 14 is shown in FIGS. 13 and 14 and referred to herein as a BugEye™ lens. This lens 18 comprises substantially optically transmissive material such as polymeric material. Examples include polycarbonate, acrylic, and silicone. A customized curved surface 69 is formed on the transmissive material using techniques similar to those employed in designing the segmented lens of FIGS. 8A and 8B; the surface, however is smooth and not facetted. The shape of the surface 69 is suitably tailored to provide the divergence, θ, and the intensity distribution desired.

In preferred embodiments, light emitted by the solid state emitter 14 propagates through the substantially transmissive material and is refracted by the BugEye™ lens. The BugEye™ lens produces a divergent beam and a far field pattern 62 that is rotationally symmetric, i.e. a substantially circular spot. This lens 18 may, for example, be specifically tailored to provide uniform intensity throughout this spot. This lens may also provide angular divergence of approximately ±45 degrees (θ) and is useful for channel letters 30 about five inches wide and five inches deep.

Figure 15:
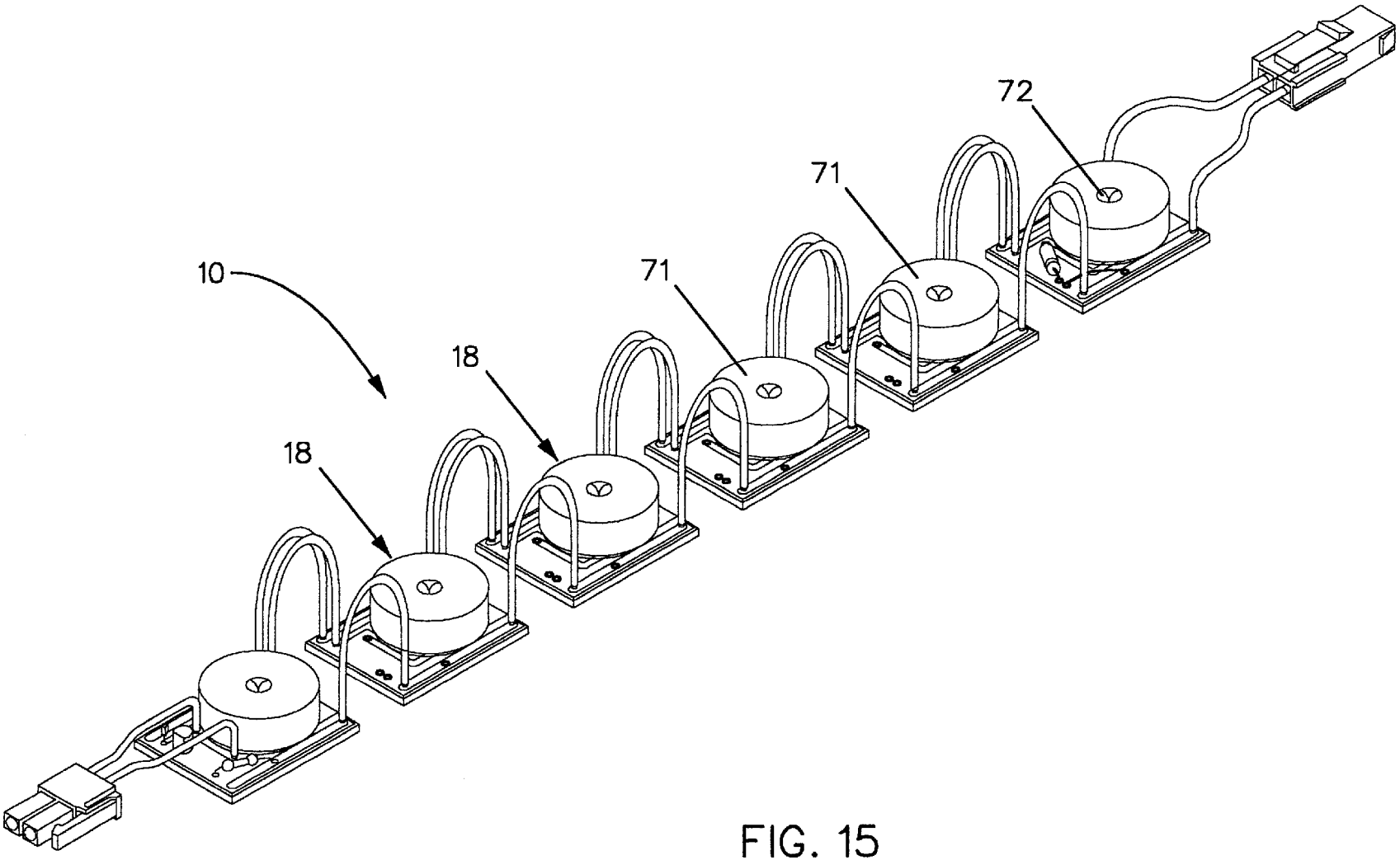
FIG. 15 is still another embodiment of the flexible lighting segment wherein the optical element above the LED comprises a optical diverter that emits light laterally.
Figure 16:
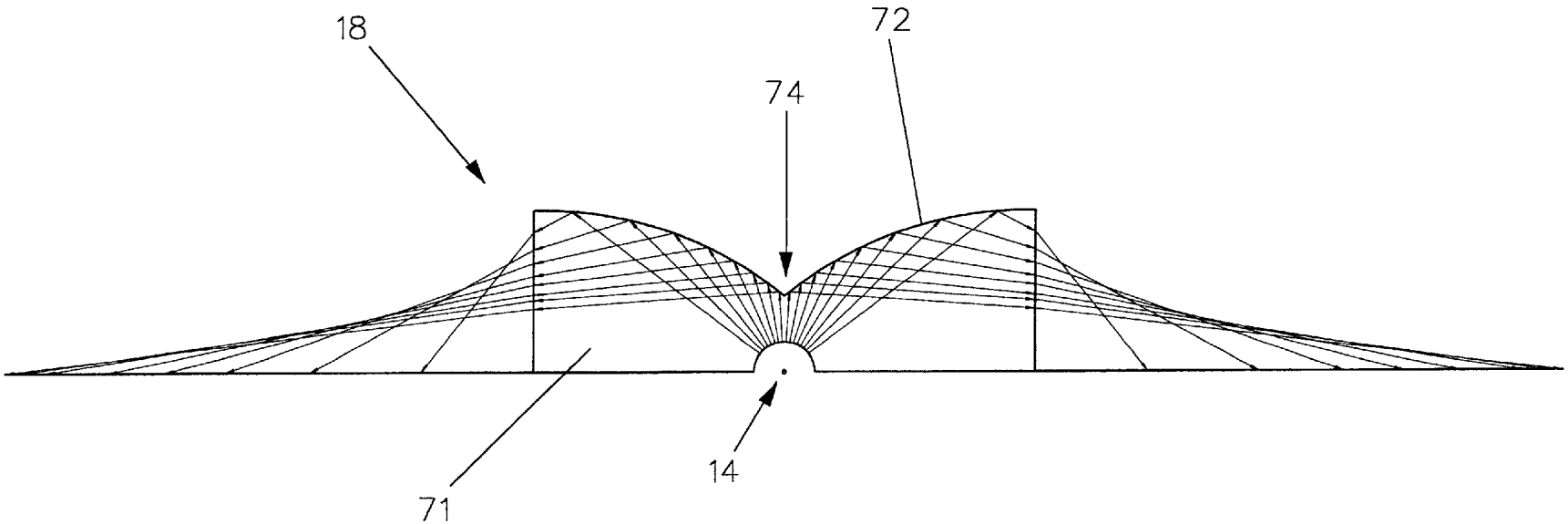
FIG. 16 is a cross-section of the optical diverter showing how light emanates therefrom.

Another optical element 18 that can be employed in the flexible lighting assembly 10 is herein referred to as an optical diverter 71 and is described in U.S. Pat. No. 6,473,554 issued Oct. 29, 2002 to Pelka et al corresponding to U.S. patent application Ser. No. 08/936,717 entitled "Lighting Apparatus Having Low Profile" filed Sep. 24, 1997 as well as U.S. patent application Ser. No. 09/620,051 entitled "Lighting Apparatus" filed on Jul. 20, 2000, still pending, both of which are incorporated herein by reference. This optical device 71 also shown in FIGS. 15 and 16, is circular or rotationally symmetric and comprises substantially optically transmissive material such as polymeric material, e.g., acrylic, polycarbonate, and silicone. The optical diverter 71 has a reflecting surface 72 formed by a flared refractive index interface. This flared refractive interface 72 is cusped, having an apex 74 positioned adjacent the optical emitter, and is configured to totally internally reflect light from the optical emitter 14 positioned to emit light towards the reflecting surface 72. Accordingly, the optical emitter 14 is aligned with the cusp 74 such that a large portion of the light from the emitter is directed toward and adjacent the cusp 72. Because the cusp 72 causes total internal reflection, light emitted by the solid state optical element 14 is re-directed by the cusp 72 so as to be dispersed downward and outward from the cusp as shown in FIG. 16. Light emitted is therefore preferentially emitted from the sides and/or below the optical element 18 rather than from the top of the optical element. Accordingly, this optical element 18 may find use in shallow channel lights 30, for example, ranging between about 3 to about 5 inches high and about 4 to about 36 inches wide. Light emitted by the solid state optical emitter 14 ejected downwardly and laterally will preferably reflect from the base 34 and the sidewalls 32 of the channel light 30 if the lighting section 12 is mounted at the base. As described above, these surfaces of the sidewalls 32 and base 34 are preferably diffusely reflecting such that, in some embodiments, a substantially uniform distribution of light will reach the front translucent panel 36.

Any of these optical elements 18 described herein can be employed in any single flexible lighting segment 10 in the flexible lighting assembly 37; one particular segment may comprise sections having different or same optical elements. Thus, in some embodiment, the optical elements 18 on a single segment 10 may be varied. The specific type of optical element 18, however, is not limited to those disclosed herein, but may comprise other optical elements well-known in the art or yet to be devised for tailoring the output of the solid state optical emitter 14 to the appropriate application. These optical element 18 may comprise refractive or diffractive optical elements, holographic optical elements, reflective elements, TIR lenses, mirrors, etc. Exemplary TIR lenses, are disclosed, for example, in U.S. Pat. No. 5,404,869 issued to Parkyn, Jr. et al. on Apr. 11, 1995, and U.S. Pat. No. 5,613,769 issued to Parkyn, Jr. et al. on Mar. 25, 1997, both of which are incorporated herein by reference.

The flexible lighting segments 10 described above are particularly suitable for use in channel lighting 31, but may also be employed to provide illumination for other structures and may be included in, for example, automotive accent lighting including tail, turn, and stop functions, planes of light for menu boards, etc. emergency lighting for airports, bridges, and the like. The flexible lighting segments 10, may find particular us in bandlights U.S. patent application Ser. No. 09/620,051 entitled "Lighting Apparatus" filed on Jul. 20, 2000, still pending, which is incorporated herein by reference) as well as in accent lighting, e.g., on top of or on the edges of buildings and other architectural structures.

What is claimed is:

1. An illumination apparatus, comprising a lighting segment comprising a plurality of lighting sections, each of said sections comprising a printed circuit board having a solid state optical emitter mounted thereon, said sections interconnected by printed circuit board connectors which serially position said printed circuit boards with edges of adjacent printed circuit boards proximate to each other, said connectors being deformable to alter the orientation in response to an applied force, said sections being electrically connected to each other such that said solid state optical emitters are electrically connected in series, said segment having a current regulator which controls current through said solid state optical emitter.

2. The illumination apparatus of claim 1, further comprising an electrical connector electrically connecting the lighting segment in parallel with another lighting segment.

3. An illumination apparatus, comprising a lighting segment comprised of a plurality of electrically interconnected sections, adjacent ones of said sections being flexibly connected to each other by connections which permit relative movement therebetween, each of said sections comprising a solid state optical emitter and an optical element, at least one optical element being a first refractive element and at least another optical element selected from the group consisting of (1) a second refractive element having different refractive characteristics than the first refractive element and (2) an optical diverter having a total internal reflection surface.

4. A method of illuminating an elongate strip of translucent material, the method comprising:

configuring a lighting segment having a plurality of serially-connected lighting sections, wherein configuring the lighting segment includes altering a separation between at least two adjacent lighting sections;

energizing the plurality of series-connected light-emitting diodes to emit light;

passing light from the plurality of light-emitting diodes through a plurality of optical elements, respectively, each of said plurality of optical elements producing an elongated pattern having a substantially uniform intensity across said pattern; and imbricating the elongated illumination patterns to substantially uniformly illuminate said elongate strip of translucent material.

5. The method of claim 4, wherein said strip of translucent material is illuminated to a uniformity of at least about 40% across said strip, wherein uniformity is defined as the difference between the maximum and minimum intensity across the strip divided by the sum of the maximum and minimum intensity across the strip.

6. The method of claim 5, wherein said strip of translucent material is illuminated to a uniformity of at least about 10% across said strip.

7. An illumination apparatus, comprising:

a segmented support structure comprising a plurality of sections which are movably connected to each other such that each section is movable in three orthogonal directions relative to an adjacent section;

a plurality of point sources mounted on said plurality of sections, respectively; and a plurality of non-rotationally symmetric lenses mounted on said plurality of sections, respectively, to receive light from said plurality of point sources, respectively.

8. The apparatus of claim 7, wherein said point sources comprise light emitting diodes.

9. The apparatus of claim 7, wherein said plurality of point sources are electrically connected together.

10. The apparatus of claim 7, wherein said plurality of point sources are electrically connected in series.

11. The apparatus of claim 7, wherein at least one of said lenses comprises a non-imaging optical element.

12. An illumination apparatus, comprising:

a lighting segment, wherein the lighting segment includes:

a first lighting section, wherein the first lighting section includes:

a first printed circuit board; and a first solid state optical emitter mounted on the printed circuit board;

a second lighting section connected to the first lighting section by a flexible interconnect such that the second lighting section can be moved in three orthogonal directions, wherein the second lighting section includes:

a second printed circuit board; and a second solid state optical emitter mounted on the second printed circuit board and electrically connected in series with the first solid state optical emitter, and a current regulator which regulates current through the first and second solid state optical emitters.

13. The apparatus of claim 12, wherein at least one of the first and second solid state emitters is selected from the group consisting of a laser diode and a light emitting diode.

14. The apparatus of claim 12, wherein the flexible interconnect includes a metal wire.

15. The apparatus of claim 12, wherein the flexible interconnect is selected from the group consisting of a conducting strip and a non-conducting strip.

16. The apparatus of claim 12, wherein the current regulator is mounted to one of the first and second printed circuit boards.

17. The apparatus of claim 12, wherein at least one of the first and second lighting sections further includes an optical element adjacent to the solid state optical emitter.

18. The apparatus of claim 17, wherein the optical element is attached to the solid state optical emitter.

19. The apparatus of claim 17, wherein the optical element is a non-imaging optical element.

20. The apparatus of claim 17, wherein the optical element is a lens.

21. The apparatus of claim 20, wherein the lens is a segmented lens.

22. The apparatus of claim 12, wherein at least one of the first and second lighting sections further includes a fastener attached thereto.

23. The apparatus of claim 12, wherein at least one of the first and second lighting sections further includes an electrical connector connected thereto.

24. The apparatus of claim 12, wherein the apparatus further includes a frame connected to at least one of the first and second printed circuit boards.

25. The apparatus of claim 12, further comprising a plurality of lighting segments.

* * * * *